US005865318A

United States Patent [19]

Yu et al.

[11] Patent Number: 5,865,318

[45] Date of Patent: Feb. 2, 1999

[54] REVERSE CRAGO PROCESS FOR SILICEOUS PHOSPHATES

[75] Inventors: Yingxue Yu; Jinrong Zhang, both of Lakeland, Fla.

[73] Assignee: Florida Institute of Phosphate Research, Bartow, Fla.

[21] Appl. No.: 924,585

[22] Filed: Sep. 5, 1997

[51] Int. Cl.[6] ..... B03D 1/02

[52] U.S. Cl. ..... 209/166; 209/12; 209/17; 209/5; 241/20; 241/24.1

[58] Field of Search ..... 209/5, 12, 17, 209/164, 166, 167; 241/20, 24.1

[56] References Cited

U.S. PATENT DOCUMENTS

| | | |
|---|---|---|
| 2,158,220 | 5/1939 | Crago . |
| 2,222,728 | 11/1940 | Tartaroa . |
| 2,293,640 | 8/1942 | Crago . |
| 2,815,859 | 12/1957 | Hollingsworth . |
| 3,013,664 | 12/1961 | Hollingworth et al. . |
| 3,086,654 | 4/1963 | Hollingsworth . |
| 3,088,590 | 5/1963 | Hasman . |
| 3,782,539 | 1/1974 | Painter . |
| 4,144,969 | 3/1979 | Snow . |
| 4,189,103 | 2/1980 | Lawver et al. . |
| 4,287,053 | 9/1981 | Lehr et al. . |
| 4,330,398 | 5/1982 | Alford . |
| 4,364,824 | 12/1982 | Snow . |
| 5,542,545 | 8/1996 | Yu . |

OTHER PUBLICATIONS

Rao, K.H., et al., 1989, "Flotation of Phosphatic Material Containing Carbonatic Gangue Using Sodium Oleate as Collector and Sodium Silicate as Modifier", *Int. J. Of Mineral Processing,* vol. 26, pp. 123–140.

Rao, D.V., 1985, "Flotation of Calcareous Mussorie Phosphate Ore", *Int. J. Mineral Processing,* vol. 14, pp. 57–66.

S. S. Hsieh and J.R. Lehr, 1985, "Beneficiation of Dolomitic Idaho Phosphate Rock by the TVA Diphosphonic Acid Depressant Process", *Mineral and Metallurgical Processing,* Feb., pp. 10–13.

R. Houot, 1982, "Beneficiation of Phosphatic Ores Through Flotation: Review of Industrial Applications and Potential Developments", *International Journal of Mineral Processing,* vol. 9, pp. 353–384.

G.A. Gruber, J. D. Raulerson, and R.P. Farias, 1987, "Adapting Technology to Beneficiate a Low–Grade Phosphorite Ore", *Minerals and Metallurgical Processing,* Feb., pp. 14–18.

E. Fu and P. Somasundaran, 1986, "Alizarin Red S as a Flotation Modifying Agent in Calcite–Apatite Systems", *International Journal of Mineral Processing,* vol. 18, pp. 287–296.

J. E. Lawver et al., Oct. 1978, "Beneficiation of Phosphate Rock A State of the Art Review", *Minerals Sci. Engineering,* vol. 10 (4), pp. 278–294.

S. I. Abu–Elshah et al., 1991, "A New Technique for the Beneficiation of Low Grade Carbonate Rich Phosphate Rocks by Digestion with Dilute Acetic Acid Solutions: Pilot Plant Testing Results", *Mineral Engineering,* vol. 4 (5/6), pp. 573–586.

(List continued on next page.)

*Primary Examiner*—Thomas M. Lithgow

*Attorney, Agent, or Firm*—Rothwell, Figg, Ernst & Kurz, p.c.

[57] ABSTRACT

An improved reverse crago process for beneficiating siliceous phosphate includes the steps of subjecting a siliceous phosphate ore material to amine floatation so as to obtain a prefloat concentrate, and screening the prefloat concentrate so as to separate it into 1) a fine predominantly phosphate fraction without substantial amounts of silica, and 2) a coarse fatty acid floatation feed fraction containing phosphate and substantial silica. The coarse fraction is subjected to fatty acid flotation so as to recover phosphate as a fatty acid flotation concentrate.

20 Claims, 2 Drawing Sheets

OTHER PUBLICATIONS

M. C. Fuerstenau et al., 1968, "The Influence of Sodium Silicate in Non–Metallic Flotation Systems", *Trans AIME,* vol. 241, pp. 319–323.

Jun. 1975, "Selective Flotation and Recovery", *Society of Mining Engineers, AIME,* vol. 258, Part 3, pp. 176–180.

Jun. 1975, "Depression of Phosphate Oolites and Calcite Flotation", *Society of Mining Engineers, AIME,* vol. 258, Part 4, pp. 181–182.

J.E. Lawver et al., 1984, "New Techniques in Beneficiation of the Florida Phosphate of the Future", *Minerals and Metallurgical Processing,* vol. 8, pp. 89–106.

Robert Snow et al., Processing Supplement Sep. 1996, "Challenging the Crago double float process: All–cationic flotation of siliceous phosphates", *Florida Institute of Phosphate Research, Phosphate Flotation,* pp. 40–46.

D. V. Rao, 1979, "Flotation of Low Grade Mussorie Phosphate Ore", *Int. Symp. On Resources Eng. And Tech.,* Jan. 8–11, pp. 1–5 and exhibits.

L. Xiao and P. Somasundaran, May 1989, "Interactions Between Oleate Collector and Alizarin Modifier in Dolomite/Francolite Flotation System," *Minerals and Metallurgical Processing,* pp. 100–103.

A. R. Rule et al., 1978, "Recent Advances in Beneficiation of Western Phosphates", *Mining Engineering,* vol. 1, pp. 37–40.

R. Houot and J.L. Polgaire, Apr. 1980, "Inverse Flotation Beneficiation of Phosphate Ore", *Proceeding,* 2nd International Congress on Phosphorus Compounds, Boston, pp. 231–246.

L. Filho et al., Dec. 5–10, 1993, "The Influence of Corn Starch on the Separation of Apatite from Gangue Minerals Via Froth Flotation," *Engineering Foundation Conference, Phosphates: Theory and Practice,* Palm Coast Florida, pp. 147–155.

T. A. B. Lawendy et al., 1993, "Flotation of Dolomitic and Calcareous Phosphate Ores," *Beneficiation of Phosphates: Theory and Practice,* 231–243, SME.

R. Smith, 1988, "Cationic And Amphoteric Collectors", *Reagents in Mineral Technology,* Marcel Dekker, pp. 219–256.

Brij M. Moudgil et al., 1986, "Advances in Phosphate Flotation," *Advances in Mineral Processing,* Arbiter Symposium, SME, pp. 426–441.

A. R. Rule et al., 1970, "Removal of Magnesium Impurities from Phosphate Rock Concentrates", *USBM RI 7362,* Contents, pp. 1–12.

A. R. Rule et al., 1974, "Flotation of Carbonate Minerals From Unaltered Phosphate Ores of Phosphoria Formation," *RI 7864,* USBM, Contents, pp. 1–18.

P.C. Good, 1976, "Beneficiation of Unweathered Indian Calcareous Phosphate Rock by Calcination and Hydration," *RI 8154,* USBM, Contents, pp. 1–17.

T. O. Llewellyn, 1982, "Beneficiation of High–Magnesium Phosphate from Southern Florida," *RI 8609,* USBM, Contents, pp. 1–16, Errata.

A. R. Rule, 1982, "Application of Carbonate–Silica Flotation Techniques to Western Phosphate Materials," *RI 8728,* USBM, Contents, pp. 1–13.

B. E. Davis et al, 1984, "Continuous Beneficiation of dolomitic Phosphate Ores," *RI 8903,* USBM, Contents, pp. 1–14.

J. E. Lawver et al., Oct. 1982, "Beneficiation of Dolomitic Florida Phosphate Reserves," *XIV International Mineral Processing Congress,* Toronto, 27 pp.

C. Clerici et al., 1984, "Flotation of a Phosphate Rock with Carbonate–Quartz Gangue," *Reagents in the Mineral Industry,* Jones, M. J. And Oblatt, R., eds., IMM, London, pp. 221–225.

Y. Tanaka et al., 1988, "Reagents in Phosphate Flotation", *Reagents in Mineral Technology,* Marcel Dekker, pp. 645–662.

E. W. Gieseke, Section editor, 1985, "Florida Phosphate Rock," *SME Mineral Processing Handbook,* Chapter 21, pp. 2–5.

T. F. Al–Fariss, 1993, "Beneficiation of a Carbonate Rich Saudi Phosphate Rocks," *Engineering Foundation Conference.* Beneficiation of Phosphates: Theory and Practice, SME, Dec. 5–10, Palm Coast, FL., pp. 251–259.

S.I. Abu–Elshah et al., 1991, "Beneficiation of Calcareous Phosphate Rocks Using Dilute Acetic Acid Solution: Optimization of Operating Conditions for Ruseifa (Jordan) Phosphate," *J. Mineral Processing,* vol. 31, pp. 116–126.

K. P. Ananthapadmanabhan and P. Somasundaran, 1985, "Surface Precipitation of Inorganics and Surfactants and its Role in Adsorption and Flotation," *Colloids Surfaces,* vol. 13, pp. 151–167.

L. Wu and W. Forsling, 1993, Surface Complexation of Calcium Minerals in Aqueous Solution—2. The complexation of Alizarin Red S at Fluorapatite–Water Interface, Engineering Foundation Conference, Beneficiation of Phosphates: Theory and Practice, Dec. 5–10, Palm Coast, Florida.

H. K. Rao et al., 1988, "Mechanism of Oleate Interaction on Salt–type Minerals, I. Adsorption and Electrokinetic Studies of Calcite in the Presence of Sodium Oleate and Sodium Metasilicate," *Colloids and Surfaces,* vol. 34, pp. 227–239.

A.N. Baumann and R. E. Snow, Apr. 1980, "Processing Techniques for Separating MgO Impurities from Phosphate Products," *Proceedings,* 2nd International Congr. Phosphorus Compounds, pp. 269–280.

Anon., Apr. 1983, "Beneficiation of High Carbonate Phosphate Ores," *Development in Fertilizer Technology,* TVA publication, pp. 48–51.

J. Leja, 1982, *Surface Chemistry of Froth Flotation,* Title page and Index, Plenum Press, New York.

B. M. Moudgil et al., "Separation of Dolomite From the South Florida Phosphate Rock", *FIPR Publication Research Project No. 82–02–023, Final Report—Feb. 1986,* Table of Contents, vol. 1 and 2, pp. XVII–XX and 1–3.

Zellars–Williams Co., 1989, "Anionic Flotation of Florida Phosphate," *FIPR Publication No. 02–063–071.*

J. Hanna and I. Anazia, 1990, "Selective Flotation of Dolomitic Limestone Impurities from Florida Phosphates," *FIPR Publication No. 02–066–089.*

H. El–Shall and M. Bogan, 1994, "Characterization of Future Florida Phosphate Resources," *FIPR Publication No. 02–082–105.*

G. A. Gruber et al., 1995, "Understanding the Basics of Anionic Conditioning in Phosphate Flotation," *FIPR Publication No. 02–090–121* and Appendices A–E.

Hassan El–Shall, Oct. 1994, "Evaluation of Dolomite Separation Techniques," *FIPR Publication No. 02–094–108.*

A.R. Rule et al., Beneficiation of Complex Phosphate Ores Containing Carbonate and Silica Gangue, pp. 380–389.

Yingxue Yu et al., "Amine–Fatty Acid Flotation Of Siliceous Phosphates, Another Challenge Of The Crago Double Float Process", 10th Annual Regional Phosphate Conference, Lakeland, Fla., Oct. 19, 1995, p. 8.

P. Zhang et al., "Challenging The Crago Double Float Process. II. Amine–Fatty Acid Flotation Of Siliceous Phosphates," Mineral Engineering '96 Conference, Brisbane, Aug. 26–29, 1996, p. 12.

REVERSE CRAGO PROCESS FOR SILICEOUS PHOSPHATES

FIELD OF THE INVENTION

The present invention relates generally to methods of beneficiating siliceous phosphates.

BACKGROUND OF THE INVENTION

The dominant process currently used for processing siliceous phosphates is the Crago "Double Float" process. In this process, deslimed phosphate ore is subjected to sizing. Typical sizing involves using a hydrosizer to size the deslimed feed into coarse (16×35 mesh) and fine (35×150 mesh) fractions. In some more sophisticated operations, three fractions are produced (16×24, 24×35, and 35×150 mesh). The sized feed is first subjected to rougher flotation after conditioning at 70% or higher solids with fatty acid/fuel oil at pH about 9 for three minutes. A significant amount of silica (sands) is also floated in this step. The rougher concentrate goes through a dewatering cyclone, an acid scrubber, and a wash box to remove the reagents from phosphate surfaces. After rinsing, the feed is transported into flotation cells where amines (sometimes with diesel) are added, and the silica is floated at neutral pH. Since about 30–40% by weight of the sands in the flotation feed are floated twice, first by fatty acid and then by amines, the Crago process is inefficient in terms of collector efficiency. Indeed, theoretical fatty acid efficiency in a typical plant is merely 5%. The rest of the reagents are wasted primarily because of silica. The trends of declining grade of phosphate deposits and soaring prices for fatty acid do not favor the standard Crago process.

Despite its inefficiency, the Crago process has been used widely in the phosphate industry in the past. However, due to increasing amine costs and decreasing phosphorous content in currently-mined ore, there is a need in the art for new methods of economically and efficiently beneficiating siliceous phosphates.

SUMMARY OF THE INVENTION

An improved reverse crago process for beneficiating siliceous phosphate includes the steps of subjecting a siliceous phosphate ore material to amine floatation so as to obtain a prefloat concentrate, and screening the prefloat concentrate so as to separate it into a 1) fine predominantly phosphate fraction without substantial amounts of silica, and 2) a coarse fatty acid floatation feed fraction containing phosphate and substantial silica. The coarse fraction is subjected to fatty acid flotation so as to recover phosphate as a fatty acid flotation concentrate.

DESCRIPTION OF THE PREFERRED EMBODIMENTS

Figure 1:
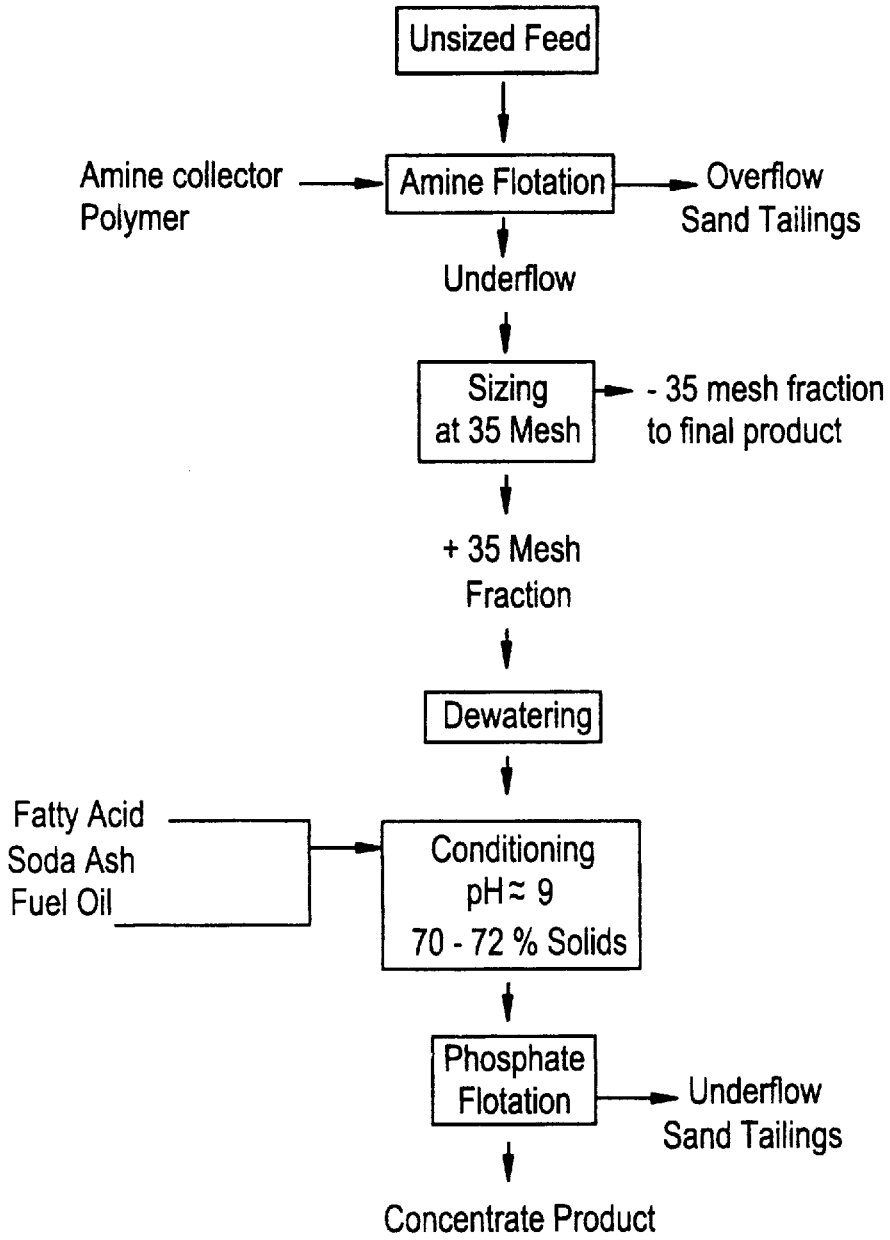
FIG. 1 is a flow chart showing one embodiment of the invention.

This invention relates to the beneficiation of siliceous phosphate minerals by flotation. More particularly, the invention relates to a more efficient processing technique for concentrating phosphate from deslimed siliceous phosphate ore. The deslimed flotation feed is first subjected to amine flotation to remove fine silica. The reagent schedule for this stage of flotation includes a commercially available amine condensate or any other amine collector added stagewise with a polymer added either in the feed and/or flotation water. Amine may also be added in a continuous manner to further reduce its consumption and improve selectivity. The prefloat concentrate is sized at an optimal mesh, typically 35 mesh, or finer depending on size and $P_2O_5$ distribution of pre-float concentrate. The fine fraction of the pre-float concentrate is recovered as a final product. The coarse fraction of the pre-float concentrate is dewatered, conditioned with a pH modifier, a commonly used fatty acid collector and a fuel oil, and floated using either mechanical cells or flotation columns to recover the phosphate, leaving coarse silica in the sink. FIG. 1 shows the flowsheet of this process.

Figure 2:
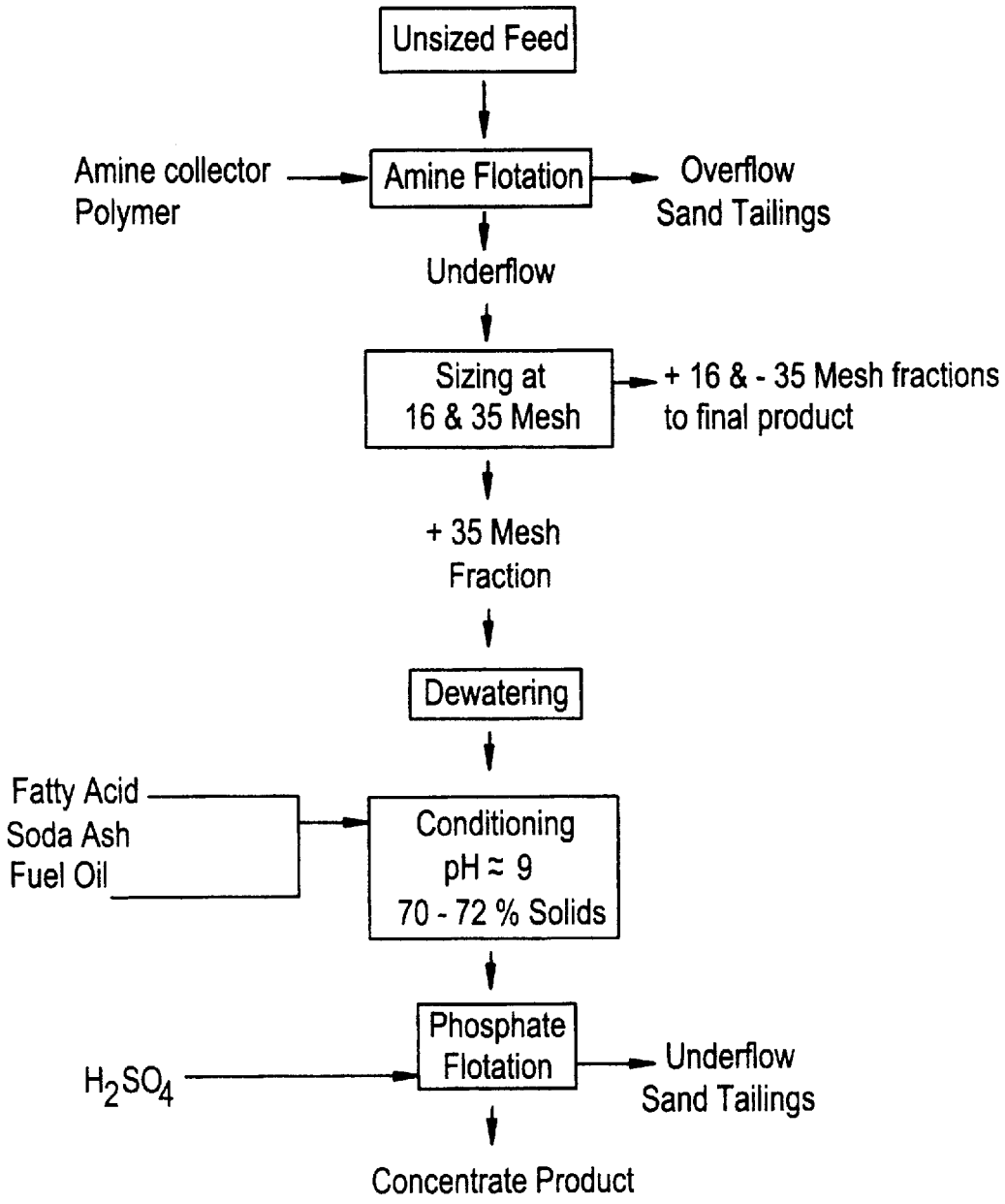
FIG. 2 is a flow chart showing another embodiment of the invention.

For feed with a substantial amount of coarse (+16M) phosphate, it may be desirable to size the pre-float concentrate at 16 mesh as well. Coarse phosphate recovery is further improved by high-pH conditioning followed by low-pH flotation. These additional steps are shown in FIG. 2.

One embodiment of the invention comprises the following steps: 1) pre-floating fine silica (sands) from a deslimed phosphate ore with an amine collector plus a small amount of polymer, 2) sizing the pre-float concentrate at 35 mesh (or finer depending on feed characteristics) to obtain a final product, the −35 mesh fraction, and a fatty acid flotation feed, the +35 mesh fraction, 3) conditioning the coarser fraction of the prefloat concentrate with soda ash, fatty acid and fuel oil, and 4) floating phosphate from silica. Sizing of the prefloat concentrate could cut fatty acid/fuel oil consumption required for the original Reverse "Crago" process by up to 50%, with substantial savings in other operating costs as well.

In these processes, fine silica is first floated with an inexpensive amine, and the prefloat concentrate is further cleaned by either floating phosphate (the amine-fatty acid flotation process, Reverse "Crago") or floating silica (the all cationic process). The Reverse "Crago" is unique in the following aspects: stepwise addition of amine, novel fatty acid flotation reagent scheme that improves recovery of coarse phosphate particles, higher collector efficiency, simplified flowsheet, and non-sizing flotation without sacrificing metallurgical recovery.

Amines are more selective collectors than fatty acids,and amine adsorbs instantaneously on sand. Amine can float more than 99% of silica from pH 3 to 12, while phosphate flotation by amine is minimal within this pH range. It was also discovered that at near neutral pHs, there is a large difference in zeta potential between silica and phosphate. Therefore, it is ideal to separate silica from phosphate at neutral pHs. Fatty acids do not readily adsorb on phosphate surfaces at neutral pH as readily as at higher pHs. We therefor float silica first. Since amine adsorbs on silica vary rapidly, the effect of clay on amine consumption may be reduced by adding amine stagewise. Flotation is conducted in a series of banks of flotation cells. Each bank consists of three to six cells. In the conventional process all the amine is added as one dose in the first flotation cell. If a small amount of amine is added in the first cell, this cell not only acts as a flotation machine, but also serves as a desliming device. Since amine flotation does not require conditioning, the number of conditioners currently used for flotation may be reduced by floating silica first. Because amine flotation is conducted at neutral pH, pH modifier consumption is significantly reduced by floating silica first. Finally and perhaps most importantly, for amine is more selective than fatty acid, collector efficiency is improved by floating silica first.

After removing fine silica in the pre-float stage, the fine fraction of the pre-float concentrate is mainly phosphate. Therefore, screening of the pre-float concentrate at an appropriate mesh gives a fine fraction which does not require fatty acid flotation thereby further reducing fatty acid and fuel oil consumption for the Reverse "Crago" process. As the following examples show, as much as 50% of the prefloat concentrate may be considered acceptable product without going through the second stage (fatty acid) flotation. This not only cuts reagent consumption by nearly half, but also reduces the number of conditioners and flotation cells. The optimal cut size varies from feed to feed. FIGS. 1 and 2 show the newly developed flowsheets.

The invention can involve the following aspects.

In preferred embodiments, the siliceous phosphate ore material which is the starting material is a deslimed siliceous phosphate ore material which has been deslimed with conventional techniques. Preferably, amine flotation also takes place in the presence of a small amount of the polymer, which can be added in the flotation feed and/or in water so as to obtain the prefloat concentrate.

In particularly preferred embodiments prior to subjecting the fatty acids flotation feed to fatty acid flotation, the fatty acid floatation feed is subjected to fatty acid conditioning.

During amine flotation, the amine can be added as one dose, stagewise during amine flotation or continuously during amine flotation.

Amine floatation preferably is conducted at a pH of from about 5 to about 8.

In particularly preferred embodiments, during fatty acid flotation, one or more acids is added, selected from the group consisting of sulfuric acid, nitric acid, hydrochloric acid, fluosilicic acid, phosphoric acid, organic acids and mixtures thereof.

In preferred embodiments, fatty acid conditioning is conducted at a pH from about 9 to about 11, and fatty acid flotation is conducted at a pH from about 5 to about 11.

Amine flotation can be conducted at a pulp density from about 20% to about 40% solids, and fatty acid flotation can be conducted at a pulp density of from about 20% to about 35% solids.

The prefloat concentrate can be sized by screening to at least two or more fractions at sizes ranging from about 14 mesh to about 100 mesh.

The polymer can be an anionic polymer, a non-ionic polymer, e.g. selected from the group consisting of polyethylene oxide and polyacrylamide, or the polymer can be a polyacrylic acid or salt thereof.

The deslimed phosphate ore material can be subjected to comminution prior to amine flotation.

Typically, amine flotation occurs for between about 1 and about 3 minutes, preferably for about 1.5 minutes, and at a pH of between about 5 and about 8, preferably at about 7. Moreover, pulp density of the feed during amine flotation is generally between about 20% and 40%, with 27% being most preferred.

Amine flotation results in, inter alia, separation of silica, particularly fine silica, from the siliceous phosphate-containing feed. Thus, any amine capable of adsorbing onto silica in the flotation feed so as to facilitate separation of silica from the feed can be used in accordance with the methods of the present invention. Such amines as are currently utilized by the phosphate industry may be used. Most preferably, the least expensive amine condensate is used.

To effect amine adsorption onto silica in the siliceous phosphate-containing flotation feed, an adsorption-effective amount of amine is added to the feed during amine flotation. Preferably, the amount of amine added to the feed is between about 0.2 and about 1.5 lb per ton. Most preferably, about 0.6 lb per ton of amine is added to the feed.

According to one aspect of the present invention, amine can be added stagewise (i.e., stepwise or in steps) or continuously during amine flotation. Adding amine stagewise or continuously during amine flotation can dramatically decrease the amount of amine needed for flotation. "Stagewise" addition is defined herein as meaning multiple (i.e., at least 2) additions of amine during amine flotation. Preferably, such multiple additions occur on a routine basis (e.g., once every 30 seconds, upon entry of the feed into a new flotation cell, etc.), although it is to be understood that for purposes of the present invention amine can be added stagewise on a non-routine basis. Moreover, the amount of amine added stagewise can vary from addition to addition. It is preferable, however, to add amine in approximately equal amounts. Continuous addition of amine during amine flotation preferably occurs at a rate of between about 0.2 and about 0.8 lb/minute per ton of feed, with a rate of about 0.6 lb/minute being most preferred, and the cumulative amount of amine added is preferably between about 0.2 and about 1.5 lb/ton of feed, with about 0.6 lb being most preferred. Although it is preferred that continuous addition of amine occurs at an approximately constant rate, it is to be understood that for purposes of the present invention the rate of amine addition can be varied throughout amine flotation.

According to another aspect of the present invention, an effective amount of a slime binding polymer can be added prior to or during amine flotation. Adding a polymer during amine flotation can dramatically decrease the amount of amine needed for flotation. The polymer can be added either to the siliceous phosphate-containing feed or to the flotation water added to the feed during amine flotation depending on quality of the feed or the water. Moreover, the polymer can be added prior to or during amine flotation regardless of whether amine is added stagewise, continuously or all at once.

Suitable polymers for use in accordance with this aspect of the present invention are polymers capable of at least partially desliming a siliceous phosphate-containing feed which also contains a substantial amount of clay (i.e., enough clay to interfere with or hinder amine flotation, typically up to about 2% by weight of the feed) so as to minimize or diminish the deleterious effects of clay on amine flotation. Such polymers include, but are not limited to, anionic polymers (e.g., anionic polyacrylamides with either carboxylic groups or sulfonate groups), nonionic polymers (e.g., polyethylene oxides, polyacrylamides, and polyvinl alcohol) and cationic polymers (e.g., cationic polyelectrolytes, polyethyleneimine). Preferably, the slime binding polymers used are anionic polyacrylamides.

Typically, the amount of polymer added prior to or during amine flotation is between about 2 and about 25 grams/ton of feed, with the addition of about 9 grams being most preferred. For example, Percol 90L can be added in amounts between about 5 and about 15 grams/ton of feed, with 9 grams being most preferred.

According to another aspect of the present invention, the siliceous phosphate-containing flotation feed subjected to amine flotation can be sized or unsized. Preferably, the flotation feed is unsized.

Preferably, the prefloat concentrate is dewatered prior to fatty acid flotation, although dewatering is not absolutely necessary. Typically, fatty acid flotation occurs for between about 0.5 and about 4 minutes, preferably for about 1.5 minutes, and at a pH of between about 5 and about 11, with a pH of 9 being most preferred. Moreover, pulp density of the feed during fatty acid flotation is generally between about 20% and about 35%, with about 23% being most preferred.

According to one aspect of the present invention, fatty acid flotation occurs in a fatty acid flotation mixture comprising at least one fatty acid and at least one fuel oil. Preferably, the fatty acid flotation mixture further comprises pH modifier such as soda ash.

Suitable fatty acids for use in the fatty acid flotation mixture include, but are not limited to, oleic acid, tall oil fatty acids, crude tall oil, tallow fatty acids, vegetable fatty acids, tall oil pitch soap, sulfonated fatty acids, petroleum sulfonates, or mixtures thereof.

Suitable fuel oils for use in the fatty acid flotation mixture include, but are not limited to, No. 5 fuel oil, recycled motor oil, or mixtures thereof.

In accordance with this aspect of the present invention, the fatty acid flotation mixture comprises 30–80% by weight fatty acid, 15–60% by weight fuel oil. Preferably, the fatty acid flotation mixture comprises 35 –60% by weight fatty acid, 40 –50% by weight fuel oil. Subsequent to fatty acid flotation, phosphates can be recovered by any suitable means.

The following examples are for illustrative purposes only, and are not to be construed in a limiting sense.

EXAMPLE 1

An unsized flotation feed was collected from a northern Florida mine, and tested using the improved Reverse "Crago" process. Characteristics of the feed are shown in Table 1.

TABLE 1

Size, $P_2O_5$ and Insol Distribution (wt. %) of the Fine Feed

| Mesh size | wt. % | % $P_2O_5$ | % Insol |
|---|---|---|---|
| +20 | 1.77 | 14.20 | 50.71 |
| 20/28 | 6.27 | 9.20 | 71.71 |
| 28/35 | 20.53 | 8.50 | 73.82 |
| 35/48 | 31.88 | 10.60 | 67.72 |
| 48/65 | 30.17 | 10.40 | 68.74 |
| 65/100 | 7.10 | 21.20 | 37.00 |
| 100/150 | 1.83 | 22.60 | 33.51 |
| −150 | 0.46 | 13.52 | 59.89 |
| Total Feed | 100 | 11.06 | 65.54 |

About 2000 grams of the fine feed was prefloated with a pound of amine condensate and 0.016 pound of polymer per ton of feed. This floated 71% of the silica in the feed. The prefloat concentrate was sized at 16 and 35 mesh. The −35 mesh fraction accounts for 52% by weight of the prefloat concentrate, and is an acceptable product with 31.4% $P_2O_5$, and 9.2% Insol. The +16 mesh fraction accounts for 1.6% by weight of the prefloat concentrate, and may be blended in the final product. The +35 mesh pre-float concentrate was conditioned at about 72% solids with 0.27 pound of soda ash and 0.45 pound of fatty acid/fuel oil per ton of feed, and then floated to separate phosphate from silica. Table 2 summarizes the flotation results.

TABLE 2

Material Balance on the Fine Feed Using the Improved Reverse "Crago"

| Stream | Weight (g) | Wt. % | % $P_2O_5$ | Insol | % $P_2O_5$ Distribution |
|---|---|---|---|---|---|
| Head | 1995.2 | 100 | 11.97 | 64.35 | 100 |
| Pre-float tails | 1043.0 | 52.28 | 1.80 | 93.82 | 7.79 |
| Pre-float Concentrate | 952.2 | 47.72 | 23.13 | 32.07 | 92.21 |
| −35 M, product #1 | 492.1 | 24.66 | 31.40 | 9.20 | 64.12 |
| +16 M, product #2 | 16.1 | 0.81 | 19.00 | 42.17 | 1.27 |
| Fatty acid tails | 238.0 | 11.93 | 0.32 | 98.60 | 0.32 |
| Fatty acid concentrate, product #3 | 206.0 | 10.32 | 31.00 | 9.07 | 26.50 |
| Total product (#1 + #2 + #3) | 714.2 | 35.80 | 31.01 | 9.91 | 91.89 |

EXAMPLE 2

A relatively coarser flotation feed from the same plant was also tested using the flowsheet shown in FIG. 2. Low-pH fatty acid flotation improved both concentrate grade and flotation recovery for feeds with more coarse (+35 mesh) phosphate particles. Table 3 is the feed analysis.

TABLE 3

Size, $P_2O_5$ and Insol Distribution (wt. %) of the Coarse Feed

| Mesh size | wt. % | % $P_2O_5$ | % Insol |
|---|---|---|---|
| +20 | 2.51 | 14.10 | 57.57 |
| 20/28 | 8.55 | 9.10 | 73.46 |
| 28/35 | 26.43 | 9.60 | 71.95 |
| 35/48 | 33.11 | 10.70 | 68.18 |
| 48/65 | 21.86 | 11.20 | 67.46 |
| 65/100 | 5.76 | 21.30 | 38.04 |
| 100/150 | 1.32 | 20.90 | 39.43 |
| −150 | 0.47 | 11.49 | 59.89 |
| Total Feed | 100 | 11.21 | 67.50 |

Table 4 shows batch scale flotation test results on the coarse flotation feed. The flotation procedure is the same as described in example 1, except that sulfuric acid is added in the fatty acid flotation stage. Reagent dosages for this test are: a pound of amine, 0.012 pound of polymer, 0.27 pound of soda ash, 0.45 pound of fatty acid/fuel oil, and 0.16 pound of sulfuric acid per ton of feed. In this case the −35 mesh fraction accounts for 48.6% by weight of the prefloat concentrate.

TABLE 4

Material Balance on the Coarse Feed Using the Improved "Reverse Crago" with Low-pH Fatty Acid Flotation

| Stream | Weight (g) | Wt. % | % $P_2O_5$ | % Insol | % $P_2O_5$ Distribution |
|---|---|---|---|---|---|
| Head | 1929.9 | 100 | 11.79 | 63.75 | 100 |
| Pre-float tails | 1031.2 | 53.43 | 1.40 | 92.70 | 6.34 |
| Pre-float Concentrate | 898.7 | 46.57 | 23.71 | 32.07 | 93.66 |
| −35 M, product #1 | 436.5 | 22.62 | 31.80 | 6.92 | 61.00 |
| +16 M, product #2 | 17.5 | 0.91 | 19.20 | 42.79 | 1.48 |
| Fatty acid tails | 224.2 | 11.62 | 0.28 | 98.88 | 0.28 |

TABLE 4-continued

Material Balance on the Coarse Feed Using the Improved "Reverse Crago" with Low-pH Fatty Acid Flotation

| Stream | Weight (g) | Wt. % | % $P_2O_5$ | % Insol | % $P_2O_5$ Distribution |
|---|---|---|---|---|---|
| Fatty acid concentrate, | 220.5 | 11.43 | 31.90 | 6.84 | 30.91 |
| product #3 | | | | | |
| Total product (#1 + #2 + #3) | 674.5 | 34.95 | 31.51 | 7.82 | 93.38 |

EXAMPLE 3

A relatively low grade flotation feed from a central Florida mine was also tested. Table 5 shows the feed properties.

TABLE 5

Size, $P_2O_5$ and Insol Distribution (wt. %) of the Low Grade Feed

| Mesh size | wt. % | % $P_2O_5$ | % Insol |
|---|---|---|---|
| +20 | 1.82 | 17.77 | 32.56 |
| 20/28 | 3.17 | 19.19 | 36.42 |
| 28/35 | 11.50 | 13.49 | 56.72 |
| 35/48 | 28.20 | 9.07 | 71.20 |
| 48/65 | 33.07 | 6.28 | 80.32 |
| 65/100 | 17.85 | 5.13 | 83.99 |
| 100/150 | 3.57 | 4.75 | 84.43 |
| −150 | 0.82 | 4.48 | 79.04 |
| Total Feed | 100 | 8.24 | 73.48 |

Table 6 shows average results of three batch scale flotation tests. The flotation procedure is the same as described in example 1. Reagent dosages for this test are: a pound of amino, 0.012 pound of polymer, 0.27 pound of soda ash, and 0.45 pound of fatty acid/fuel oil per ton of feed. The −35 mesh fraction accounts for 50.6% by weight of the prefloat concentrate.

TABLE 6

Material Balance on a Low-grade Feed Using the Improved Reverse "Crago"

| Stream | Weight, (g) | Wt. % | % $P_2O_5$ | % Insol | % $P_2O_5$ Distribution |
|---|---|---|---|---|---|
| Head | 6097.6 | 100 | 8.36 | 75.21 | 100 |
| Pre-float tails | 4329.9 | 71.01 | 0.99 | 96.74 | 8.39 |
| Pre-float Concentrate | 1767.7 | 28.99 | 26.41 | 22.47 | 91.60 |
| −35 M, product #1 | 893.7 | 14.66 | 32.00 | 6.62 | 56.10 |
| +16 M, product #2 | 48.4 | 0.79 | 27.70 | 16.31 | 2.63 |
| Fatty acid tails | 276.1 | 4.53 | 1.14 | 95.04 | 0.61 |
| Fatty acid concentrate, | 549.5 | 9.01 | 29.92 | 12.37 | 32.25 |
| product #3 | | | | | |
| Total product (#1 + #2 + #3) | 1491.6 | 24.46 | 31.10 | 9.04 | 91.00 |

EXAMPLE 4

As is pointed out above, the optimal screening size for the prefloat concentrate depends on size and $P_2O_5$ distribution of flotation feed. Amine dosage in the prefloat stage also has an significant effect on the ideal cut size. Several prefloat tests were conducted on a low-grade feed analyzing 3.9% $P_2O_5$, and 88.2% Insol to demonstrate the effect of amine dosage. Table 7 summarizes analyses of several size fractions of prefloat concentrates from different amine dosages.

Table 7. Effect of Amine Dosages on $P_2O_5$ and Distribution (%) in Different Size Fractions of the Pre-float Concentrate

TABLE 7

Effect of Amine Dosages on $P_2O_5$ and Distribution (%) in Different Size Fractions of the Pre-float Concentrate

| Amine dosage, Ib/ton | −35 Mesh Fraction | | | −48 Mesh Fraction | | | −65 Mesh Fraction | | |
|---|---|---|---|---|---|---|---|---|---|
| of feed | wt. % | $P_2O_5$ | Insol | wt. % | $P_2O_5$ | Insol | wt. % | $P_2O_5$ | Insol |
| 0.64 | 57.00 | 26.30 | 22.09 | 31.80 | 31.87 | 5.48 | 14.94 | 33.20 | 3.37 |
| 0.60 | 58.65 | 23.97 | 29.09 | 30.80 | 31.63 | 7.30 | 14.45 | 32.90 | 3.69 |
| 0.54 | 60.96 | 22.09 | 34.02 | 30.64 | 31.29 | 7.58 | 15.22 | 32.50 | 3.62 |

What is claimed is:

1. A method of beneficiating siliceous phosphates comprising the steps of:

(a) subjecting a siliceous phosphate ore material to amine flotation so as to form a float fraction having an increased silicate content and a non-float fraction in a form of a prefloat concentrate having an increased phosphate content;

(b) screening the prefloat concentrate to separate the prefloat concentrate into a fine predominantly phosphate fraction without substantial amounts of silica, and a coarse fraction comprising a fatty acid flotation feed containing phosphate and substantial silica; and (c) subjecting the fatty acid flotation feed to fatty acid floatation so as to produce a fatty acid floatation concentrate.

2. The method of claim 1, wherein the siliceous phosphate ore material is a deslimed silicious phosphate ore material.

3. The method of claim 2, wherein the siliceous phosphate ore material is further deslimed with a slime binding polymer.

4. The method of claim 3, wherein said amine flotation takes place in the present of said slime binding polymer.

5. The method of claim 1, wherein prior to subjecting the fatty acid flotation feed to fatty acid flotation, the fatty acid flotation feed is subjected to fatty acid conditioning.

6. The method of claim 1 wherein said screening is carried out at about 35 mesh or finer to produce said fine fraction and said coarse fraction.

7. The method of claim 6, wherein prior to screening at said about 35 mesh said prefloat concentrate is screened at about 16 mesh to obtain an about +16 mesh fraction.

8. The method of claim 1, wherein amine is added as one dose during amine floatation.

9. The method of claim 1, wherein amine is added stagewise during amine flotation.

10. The method of claim 1, wherein amine is added continuously during amine floatation.

11. The method of claim 1, wherein amine flotation is conducted at a pH from about 5 to about 8.

12. The method of claim 1, wherein an acid is added during fatty acid flotation.

13. The method of claim 12, wherein the acid is selected from the group consisting of sulfuric acid, nitric acid, hydrochloric acid, fluosilicic, phosphoric acid, organic acids and mixtures thereof.

14. The method of claim 5, wherein fatty acid conditioning is conducted at a pH of from about 9 to about 11, and fatty acid flotation is conducted at a pH of from about 5 to about 11.

15. The method of claim 1, wherein amine flotation is conducted at a pulp density of from about 20% to about 40% solids, and fatty acid flotation is conducted at a pulp density from about 20% to about 35% solids.

16. The method of claim 1, wherein the prefloat concentrate is sized by screening to at least two fractions at sizes ranging from about 14 to about 100 mesh.

17. The method of claim 3 wherein the polymer is an anionic polymer.

18. The method of claim 3 wherein the polymer is a non-ionic polymer selected from the group consisting of a polyethelene oxide and a polyacrylamide.

19. The method of claim 3 wherein the polymer is a polyacrylic acid or a salt thereof.

20. The method of claim 2 wherein the deslimed phosphate ore material is subjected to comminution prior to amine flotation.

* * * * *